US008210245B2

(12) United States Patent
Gillessen et al.

(10) Patent No.: US 8,210,245 B2
(45) Date of Patent: Jul. 3, 2012

(54) SHELL-AND-TUBE HEAT EXCHANGER COMPRISING A WEAR-RESISTANT TUBE PLATE LINING

(75) Inventors: Christoph Gillessen, Schermbeck (DE); Helmut Schielke, Herten (DE); Marco Heisterkamp, Bocholt (DE); Werner Oelmann, Dorsten (DE); Oliver Schwarz, Raesfeld (DE)

(73) Assignee: Ruhr Oel GmbH, Gelsenkirchen (DE)

( * ) Notice: Subject to any disclaimer, the term of this patent is extended or adjusted under 35 U.S.C. 154(b) by 1153 days.

(21) Appl. No.: 11/994,991

(22) PCT Filed: Jul. 3, 2006

(86) PCT No.: PCT/EP2006/006440

§ 371 (c)(1),
(2), (4) Date: Jan. 7, 2008

(87) PCT Pub. No.: WO2007/006446

PCT Pub. Date: Jan. 18, 2007

(65) Prior Publication Data

US 2008/0202732 A1 Aug. 28, 2008

(30) Foreign Application Priority Data

Jul. 7, 2005 (DE) ..... 10 2005 032 118

(51) Int. Cl.
*F28F 19/00* (2006.01)
*F28F 9/02* (2006.01)

(52) U.S. Cl. ..... 165/134.1; 165/158

(58) Field of Classification Search ..... 165/134.1, 165/157, 158, 173, 177; 138/97
See application file for complete search history.

(56) References Cited

U.S. PATENT DOCUMENTS

| | | | | |
|---|---|---|---|---|
| 3,552,487 | A | 1/1971 | Tokumitsu et al. | |
| 3,592,261 | A | 7/1971 | Black | |
| 3,707,186 | A * | 12/1972 | Zorrilla et al. | 165/134.1 |
| 4,071,083 | A * | 1/1978 | Droin | 165/173 |
| 4,124,068 | A | 11/1978 | Thompson | |
| 4,152,818 | A | 5/1979 | Mort et al. | |
| 4,288,109 | A | 9/1981 | Ellis | |
| 4,390,858 | A | 6/1983 | Schulzer | |
| 4,442,052 | A * | 4/1984 | Reynertson | 264/30 |
| 4,706,743 | A * | 11/1987 | Chalimbaud | 165/134.1 |
| 4,897,908 | A * | 2/1990 | Henriksson | 29/890.044 |
| 4,941,512 | A * | 7/1990 | McParland | 138/97 |

(Continued)

FOREIGN PATENT DOCUMENTS

DE 881 199 C 6/1953

(Continued)

OTHER PUBLICATIONS

English Translation of German Office action dated Nov. 3, 2005 issued in German Priority Application No. 10 2005 032 118.6.

*Primary Examiner* — Tho V Duong
(74) *Attorney, Agent, or Firm* — Knobbe, Martens, Olson & Bear, LLP

(57) ABSTRACT

The invention relates to shell-and-tube heat exchangers, including those used to cool cracking gas in petroleum refining, containing wear resistant tube plate linings. In the heat exchangers, at least a portion of the inlet tube plate is covered by wear-resistant inserts which can be at least partially inserted into the heat exchanger tubes.

11 Claims, 2 Drawing Sheets

U.S. PATENT DOCUMENTS

| | | | | |
|---|---|---|---|---|
| 5,246,063 | A | 9/1993 | Fix et al. | |
| 5,724,470 | A | 3/1998 | Kanota et al. | |
| 5,775,269 | A * | 7/1998 | Lawrence | 122/511 |
| 5,826,647 | A | 10/1998 | Engelhardt et al. | |
| 6,155,337 | A | 12/2000 | Rosengarten et al. | |
| 6,871,774 | B2 * | 3/2005 | DeSalve | 228/183 |
| 2003/0192680 | A1 * | 10/2003 | Blanda et al. | 165/134.1 |

FOREIGN PATENT DOCUMENTS

| | | | |
|---|---|---|---|
| DE | 1 184 568 | | 12/1964 |
| DE | 21 60 372 | | 6/1973 |
| DE | 239 465 | A1 | 9/1986 |
| DE | 3806117 | A1 * | 9/1989 |
| DE | 40 12 045 | | 10/1991 |
| DE | 195 36 300 | C1 | 4/1997 |
| EP | 0 451 507 | | 10/1991 |
| FR | 878 494 | A | 1/1943 |
| GB | 1 141 239 | | 1/1969 |
| GB | 2 092 691 | | 8/1982 |
| NL | 7 016 348 | | 5/1972 |

* cited by examiner

SHELL-AND-TUBE HEAT EXCHANGER COMPRISING A WEAR-RESISTANT TUBE PLATE LINING

CROSS-REFERENCE TO RELATED APPLICATIONS

This application is the U.S. National Phase under 35 U.S.C. §371 of International Application No. PCT/EP2006/006440, filed Jul. 3, 2006, which claims priority to German Application No. 10 2005 032 118.6, filed Jul. 7, 2005.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

BACKGROUND OF THE INVENTION (1) Field of the Invention

The invention pertains to a shell-and-tube heat exchanger (THE) which contains a wear-resistant tube plate lining for application in thermal cracking equipment.

(2) Description of Related Art

Shell-and-tube heat exchangers of this type are used, for example, in ethylene equipment to produce ethylene through thermal cracking downstream from the transfer line of a cracking furnace and are referred to as quench coolers (transfer line exchangers, or TLE's).

Quench coolers must conform to unusually high standards of construction and material characteristics. The hot reaction mixture discharged from a cracking furnace after pyrolysis of hydrocarbon materials such as naphtha, LPG, ethane, or even hydrocracking residue (unconverted oil, waxy), which can reach temperatures of approximately 850° C., must be cooled quickly in the quench coolers in order to avoid undesirable side reactions. The quench cooler, or THE, functions as a waste heat boiler in which high steam pressure can be created through evaporation of feed water introduced to the casing side.

Coking retardation occurs in cracking furnaces during this process, which must be removed at specific intervals (60-80 days) through oxidation with air. In order to remove the coking, the furnace is heated to minimal operating levels and a mixture of air and steam is introduced into the tubes of the cracking furnace. The carbon residues are burned off with this mixture. Particles of coking are loosened at the same time, and they are carried with the gasses along the cracked gas pathways through the quench cooler and into the coking removal conduits.

The cracked gas or coking removal gas, which is discharged at high velocity from the cracking furnace, generally crosses a transfer line into an axial gas entry chamber and then, from below, into the quench cooler, where it collides against the lower tube plates before it is fed into the remainder of the process after its journey through the heat exchanging tubes of the quench cooler.

In spite of short exposure periods, the cracking gas contains coking particles which become highly corrosive at the high velocities reached by the cracking gas. In order to cool the hot reaction mixture created in the cracking furnace quickly, the distance between cracking furnace and the cooling tubes must be traversed as quickly as possible. This necessitates that the gas entry chamber design be compressed, which would normally broaden out in diameter of the transfer line leading to the cooler, with the result that the stream of gas containing coking particulate is concentrated on the middle region of the tube plate and the cooling tubes, which are affected particularly severely. The weight-bearing wall elements are weakened, which creates the necessity of significant maintenance costs, and maintenance downtimes result in production downtimes.

Various solutions have been proposed to this and similar problems. These are based on using of ceramic, fireproof materials as linings, structural members, or emulsions:

EP-A-0 567 674 introduces heat exchangers for the cooling of synthetic gas created in coal gasification equipment. In this application, the tube plate on the gas inlet side is covered by cuboid-based nozzles which are positioned adjacent to and abutting one another on the outer edges. Each of these nozzles has a conical opening which narrows to a section of tubing which in turn is inserted into a heat exchanger tube. This solution offers no gastight closure between the individual cuboid-based elements. This would lead to buildup of coking residue in the empty spaces within the quench coolers of an olefin processor and destroy the materials. In addition, the ends of the nozzles which are used would form a tearing edge within the tube which, considering the high flow velocities within the quench coolers, would result in heavy turbulences. This would result in additional erosion.

In DE-C-44 04068 a ceramic lining is revealed, which is comprised of fireproof molded elements. These can in some instances be hexagonal in shape and contain perforations through which pins or hooks can be inserted which are welded to the underside of the tube plate. The molded element can be attached to the tube plate in this fashion. This construction does not accomplish the goal of having a seamless emulsion or lamination.

In addition, it is widely accepted that a cooling tube installed within a reactor must be equipped with a fireproof lining which is resistant to erosion (see U.S. Pat. No. 4,124,068), in order to reduce the risk of tube failure and the resulting penetration of cooling water into the surrounding reaction mixture at elevated temperatures.

The suggestion is made in DE 195 34 823 A 1 that tube plates on the gas inlet side be coated or lined with a chemically hardened, erosion-resistant, fireproof product. This coating should initially be formed from a castable substance, applied in a pliable format, and finally fired to achieve its final format as a fireproof mass.

What these applications have in common is that they all combine ceramic—in other words, non-metallic—materials with the metallic apparatus material, principally steel. Practical experience has taught that combining ceramic and metallic components results in increased time, effort, and expense during manufacture, assembly, and repair and often creates problems because of the differences in material characteristics such as thermal expansion coefficients and varying levels of elasticity (brittle vs. ductile). In addition to these issues, inserted ceramic nozzles also have the problem of turbulence and the accompanying particular stresses to the materials at the rear end of the nozzle (from the perspective of flow direction) associated with the tearing edge located there. Contrary to the design laid out in DE 195 34 823, installing a lining consisting of a fireproof mass positioned solely in the focal area in the center of the tube plate has been shown to be impractical because the resulting inconsistent surface of the tube plate, in conjunction with the variations in material characteristics, results in the occurrence of particular problems in the transition range, i.e., at the outer edge of the fireproof form, possibly through chipping or spalling of the form or through particularly heavy erosion caused by turbulence at the edge. It should also be noted that installation of a lining made of a fireproof material only protects the tube plate as such. There is a distinct advantage to providing protection for at least the front part of each cooling tube (viewed from the perspective of flow direction). This can only be accomplished by applying a protective nozzle or sleeve.

The problem of a significantly stronger flow rate and stress on the focal area as compared to the peripheral areas was also investigated. One proposed solution incorporated cone-shaped fittings (see U.S. Pat. No. 3,552,487). Another proposed installing diffuser-type diversion fixtures which could be free-standing within the entry chamber (see DE-PS 21 60 372).

For the purposes of equalizing the flow through the entry chamber and also protecting the tube plate from erosion, an additional suggestion has been made that the THE be fitted out with inserted elements made of small rods bent into the shape of rings. The rings would be aligned along the surface of a cone, and the point of the cone would be directed toward the gas inlet (see EP 037 089 A1).

The intention here is that the coking particles carried along in the focal range of the high-velocity gas flow would be decelerated and in part deflected outward in a radial pattern, so that they would then no longer contribute to erosion damage on the tube plate and the tubes. However, an undesirable differential pressure and the associated increased exposure time would result with fittings of this type, meaning that there would be a yield loss.

BRIEF SUMMARY OF THE INVENTION

This invention takes a different approach, in that it attempts to provide an effective wear protection by applying a metallic lining to the tube plate and to the entry space of the cooling tubes. Erosion at the inlet side tube plate and in the cooling tubes made it necessary to periodically shut down the quench cooler for purposes of inspection and maintenance. In the past, people attempted to correct the problem by welding material onto the tube plates in order to return them to the required wall thickness and periodically replacing the cooling tubes. This process is very complicated and costly and is also unsatisfactory in terms of the resistance capabilities of the replacement materials, since these might very well have the same characteristics as the materials that were originally used.

DETAIL DESCRIPTION OF THE INVENTION

It has been established that the material erosion in the gas inlet region is not caused solely by mechanical erosion, but by the combined effects of high-temperature corrosion (scaling) and mechanical erosion of the corrosion product that has been formed (iron oxide).

Thus, one of the objectives of the invention is to apply a metallic lining which is highly resistant to high-temperature corrosion to the tube plates and the inlet region of the cooling tubes. All other characteristics of the lining must have similar material characteristics to the rest of the equipment material (ductility, heat expansion coefficient). It must be possible to add a partial lining without causing any negative side effects. In addition, the lining should be easy to install and easy to remove or replace.

These objectives were met by developing a shell-and-tube heat exchanger (THE) equipped with a tube plate lining which is resistant to the wear occurring in these conditions for use in thermal cracking equipment which contains cooling tubes (1) through which the gas to be cooled is circulated, each tube being secured by a tube plate at both ends of the tube and enclosed in a casing through which a coolant material is circulated. (2) The surface of the tube plate on the gas inlet side which is impacted by gas as it enters the shell-and-tube heat exchanger should be faced, at least partially, by a protective layer which is created by aligning individual sleeves side-to-side and end-to-end at the outer edges and inserting the tube ends into them (FIG. 1), typified by the fact that the insert sleeves are created from a heat-resistant metallic material.

In principle (FIG. 2), the insert sleeves are simply constructed; the most basic application consists of a tube (4) and a plate (5). One end of the tube is attached to the plate such that the surface of the plate is positioned at a 90° angle to the length axis of the tube. In other words, one could say that the tube stands vertically on top of the plate. The plate (FIG. 3) is perforated to allow the inflowing gas to pass through the plate into the tube. In the most basic application of this principle, a hole would simply be drilled in the plate. Preferably, the diameter of the drilled opening should be similar or equal to the internal diameter of the tube. The insert tubes can be manufactured either by welded construction, by machining processes, by casting, or by precision cold forging.

Ideally, the plate should be aligned with the center of the tube cross section. The tube's length axis is then threaded through the center of the plate surface. Logically, the drilled hole mentioned above is also located in the center of the plate surface.

Figure 1:
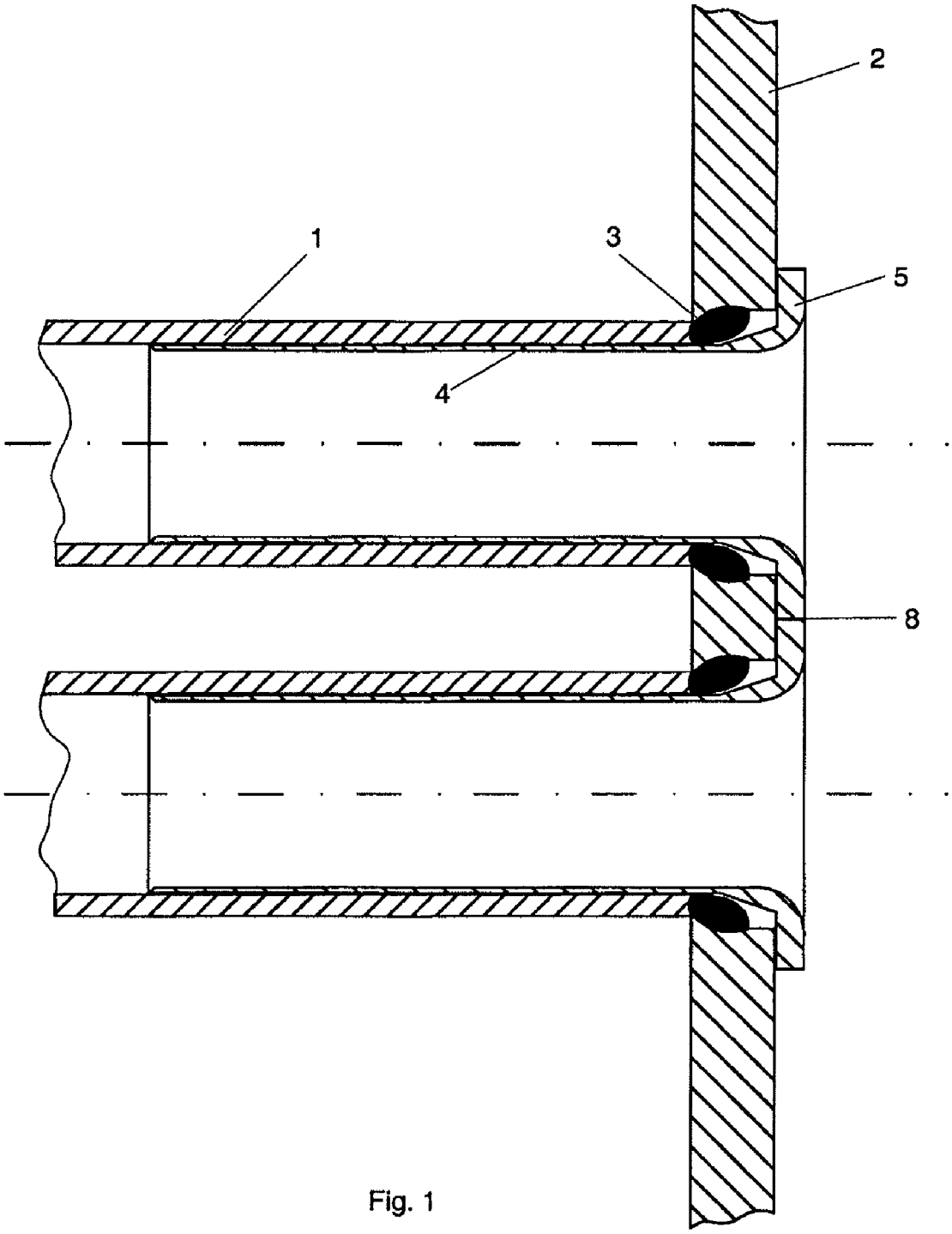
FIG. 1 shows a cross-section drawing through a tube plate (2) with, in this instance, 2 exemplary cooling tubes (1) which are connected to the base plate by means of a tube weld (3). A single sleeve consisting of a sleeve tube (4) and a sleeve plate (5) is inserted in each cooling tube. The plates attached to the sleeves of neighboring tubes (1) share a common edging rim (8), against which they all abut, fitting precisely. This makes it possible to completely cover the tube plate (2). The inflowing cracking gas is thus prevented from striking the plate, instead striking the face of the insert sleeve plate.

The plate itself is designed with a shape that allows the outer edges of the plate to abut the outer edges of the plates of adjoining sleeves in such a manner as to provide at least a partial continuous, gapless covering for the tube plate on the inlet side (FIG. 1).

The choice of which geometric shape is best suited for the plates depends upon the geometric relationship in which the individual cooling tubes are positioned relative to one another. Suitable individual geometric shapes which would create a solid, continuous larger surface when positioned next to each other would include, for example, triangular surfaces (especially isosceles, where all sides are the same length), rectangular surfaces (especially squares, but diamonds or rhombuses would be appropriate), and hexagons (especially those where all angles and sides are identical). If the tubes in the shell are positioned such that the top view looks like a grid network, where each tube marks a grid intersection and where the grid is square, then it would be preferable that the plates of all the sleeves would be square.

Conveniently, the sleeve in the tube has an outer diameter which is equal to or only slightly smaller than the inner diameter measurement of the cooling tube. This is the only way that the insert sleeves, with their attached tubes, be fitted exactly into the cooing tubes. It has been established through practical application that the optimal length for tubes on the insert sleeves lies somewhere in the area of between 50 and 200 mm; tubes measuring between 70 and 150 mm in length are especially suitable. Tubes measuring between 100 and 120 mm are especially optimal, because this measurement is equal to the length of the tube section of the cooling tube which is subject to the greatest impact under operating conditions.

The material thickness of the tubes and the plate of the insert sleeves are adapted to the rest of the dimensions of the THE and particular operating conditions. Generally, a tube wall thickness of about 1 mm is optimal. The preferred thickness of the plate is between 2 mm and 10 mm.

As mentioned above, material erosion in the gas inlet region, especially in the highly impacted central region of the tube plate, by the combined effects of high-temperature corrosion (scaling) and mechanical erosion of the corrosion product that has been formed (iron oxide). As such, this is a new awareness that has not previously been considered in the industry, where it has always been accepted that material erosion has been caused solely, or at least primarily, by mechanical abrasion. This assumption has prevented the experts in the field from considering installing metallic linings instead of linings created from ceramic or other fireproof masses, especially since common methods of welding in earlier times were difficult and expensive and did not result in satisfactorily long operating times.

This invention is also based upon the realization that metallic materials which have been adequately tempered against high temperature corrosion through specific conditions—in other words, on which corrosion products are not constantly being formed on the surface—are then also sufficiently resistant to the purely mechanical stresses of abrasion. Because of this, the preferred materials are high-temperature, corrosion-resistant alloys, especially steels containing chrome and nickel-based alloys. Because of their durability under the process conditions outlined here, austenitic steels are especially preferable for use in manufacture of the insert tubes.

In order to achieve an optimal gas flow, this inlet in the sleeves is shaped conically or rounded off (6).

In order to prevent a tearing edge from forming at the rear end of the sleeve as it has been inserted into the cooling tube, which might result in turbulence and material erosion within the cooing tube, the end of the tube which is placed against the plate is attached to the insert sleeve (7).

An additional advantage of the insert sleeves as they are employed in this invention is in the formability of the metallic materials out of which they are constructed. This makes it possible to attach the sleeves to the cooling tube in a secure and continuous seam using a simple, common procedure such as rolling. In addition to rolling, the process of hydraulic fastening can be used.

The material characteristics of the insert sleeves make it possible to produce the sleeves with a thin wall, which further minimizes the formation of tearing edge at the opposite end of the tube from the face. Also, a very thin wall which is firmly attached to the cooling tubes will have only a very minimal effect on heat transfer and the cooling operation of the THE will not be impacted at this point.

In comparison with the current state-of-the-art technology, this invention exhibits the following advantages:

- Compared to ceramic, the elements or insert sleeves, are very robust and do not need any special protection against bumping or falling.
- The stability of the cooling tubes and of the sleeves is not placed under as much strain as when ceramic is used. Among other reasons, this is because permanent connection between cooling tube and sleeve tube is not completed until the rolling or hydraulic fastening takes place. This means that the process is applicable for repairs or modifications to previously-used coolers with cooling tubes which have been increased in internal diameter by removal. On machines such as these that have previously been damaged, it becomes necessary to make an additional expansion because of the material removal that has already taken place, but with the materials used it becomes easily do-able. The insert sleeves are then attached by rolling or hydraulic fastening and widened slightly more than they would be on comparable undamaged cooling tubes.
- Low manufacturing costs due to use of common materials and processes, automatable mass production.
- Installation of a cooler requires only minimal preliminary work, such as sandblasting, but no additional treatment of the outer surface and no closing of tubes as would be necessary, for example, when applying a pliable mass.
- Assembly costs are minimal, since tools required for this assembly are all commonly-used standard tools.
- Installation period is comparatively short, since no anchors, screws, or similar attachments must be installed. Likewise, there is no need for welding or firing, as there would be, for example, with a pliable mass.
- Another very important aspect is the quick and easy disassembly of the installed insert sleeves, with no danger of damage to the cooler. Preferably, a suitable tool (such as an internal pipe cutter, milling cutter, or drill) would be used to make a split cut between the plate and the tube. After removal of the plate, an arbor would be inserted between the cooling tube and the sleeve tube, onto which the sleeve tube would be manually pulled.
- The plates of the insert sleeves can be chamfered at the edges, meaning where the sleeve edges form the outer rim of the total formed surface and do not abut adjoining insert sleeves, so that they do not form a sharp ridge between the insert sleeve plate and the tube plate.

Application of the shell-and-tube heat transfer exchanger as outlined in this invention is not limited to thermal cracking equipment. In fact, it can be applied to other processes where similar stresses impact the materials because of the operating conditions such as, for example, downstream from fluidized bed combustion or combustion turbines.

Shell-and-tube heat exchangers as outlined in this invention can be designed to accommodate all common construction formats, including fixed plate, floating head, and U-bend heat exchangers. Fixed-plate heat exchangers are commonly used in cracking facilities.

FIG. 1 shows a cross-section drawing through a tube plate (2) with, in this instance, 2 exemplary cooling tubes (1) which are connected to the base plate by means of a tube weld (3). A single sleeve consisting of a sleeve tube (4) and a sleeve plate (5) is inserted in each cooling tube. The plates attached to the sleeves of neighboring tubes (1) share a common edging rim (8), against which they all abut, fitting precisely. This makes it possible to completely cover the tube plate (2). The inflowing cracking gas is thus prevented from striking the plate, instead striking the face of the insert sleeve plate.

Figure 2:
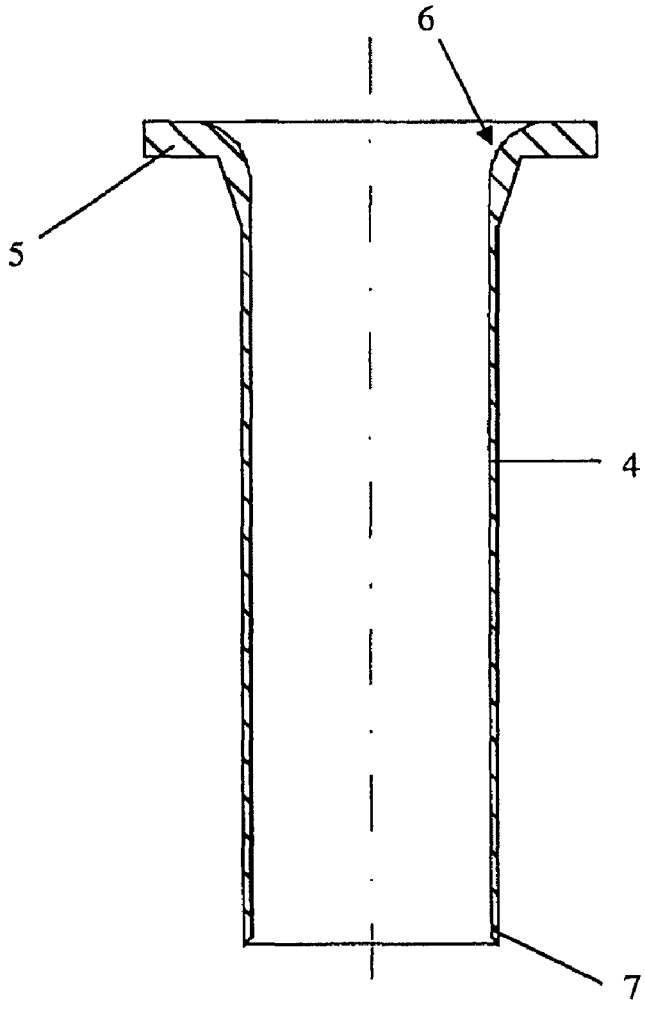
FIG. 2 depicts the longitudinal section of an insert sleeve.
Figure 3:
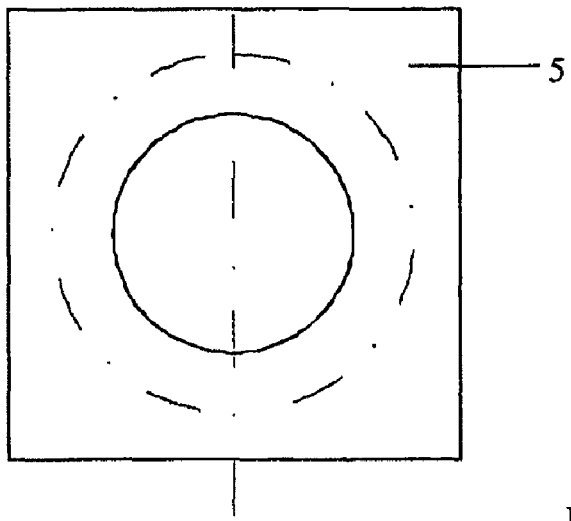
FIG. 3 depicts the top view of the same sleeve. The sleeve consists of the sleeve tube (4) and the sleeve plate (5). The rounded entry region (6) and the chamfered tube end (7) are also clearly recognizable.

FIG. 2 depicts the longitudinal section of an insert sleeve, and FIG. 3 depicts the top view of the same sleeve. The sleeve consists of the sleeve tube (4) and the sleeve plate (5). The rounded entry region (6) and the chamfered tube end (7) are also clearly recognizable.

REFERENCE KEY LIST (1) Cooling tube
(2) Tube plate
(3) Tube weld
(4) Sleeve tube
(5) Sleeve plate
(6) Rounded entry region
(7) Chamfered tube end
(8) Edging rim

The invention claimed is:

1. A shell-and-tube heat exchanger equipped with a tube plate lining which is resistant to wear for use in thermal cracking equipment comprising:

cooling tubes through which the gas to be cooled is circulated, each tube being secured by a tube plate at both ends of the tube and enclosed in a casing through which a coolant material is circulated;

the surface of the tube plate on the gas inlet side which is impacted by gas as it enters the shell-and-tube heat exchanger is faced, at least partially, by a protective layer;

the protective layer comprising insert sleeves;

inserted at least partially into the cooling tube ends; and the insert sleeves being made from a heat resistant metallic material;

wherein the insert sleeves are constructed of an austenitic steel material;

wherein each of the insert sleeves consists essentially of a sleeve tube and a plate, and the sleeve tube has a length of about 100 to 120 mm; and wherein a plate of one of the insert sleeves is aligned side-to-side and end-to-end at its outer edges with a plate of another insert sleeve.

2. The shell-and-tube heat exchanger of claim 1, wherein the the sleeve tube has a longitudinal axis and a first end; and the sleeve tube is attached at the first end to the plate which is situated at about a 90° angle to the longitudinal axis of the sleeve tube and is perforated in such a way as to allow the inflowing gases to pass through the plate and into the sleeve tube.

3. The shell-and-tube heat exchanger of claim 1, wherein the center of the plate is approximately aligned with the center of the of the cross-section of the sleeve tube.

4. The shell-and-tube heat exchanger of claim 1, wherein the plate has outer edges, the outer edges designed with a shape that allows the outer edges of the plate to abut the outer edges of the plates of adjoining sleeves in such a manner as to provide at least a partial continuous, gapless covering for the tube plate on the inlet side.

5. The shell-and-tube heat exchanger of claim 1, wherein the plate is substantially square or rectangular in shape.

6. The shell-and-tube heat exchanger of claim 1, wherein the sleeve tube has an external diameter and the cooling tubes have an interior diameter, the external diameter of the sleeve tube being only slightly smaller than the interior diameter of the cooling tubes.

7. The shell-and-tube heat exchanger of claim 1, wherein the sleeve tube has a wall thickness of about 1 mm.

8. The shell-and-tube heat exchanger of claim 1, wherein the plate has a thickness of about 2 to about 110 mm.

9. The shell-and-tube heat exchanger of claim 1, wherein the sleeve tube has a second end, the second end being chamfered.

10. The shell-and-tube heat exchanger of claim 1, wherein the insert sleeve is firmly attached to the respective cooling tube by rolling or hydraulic expansion.

11. A process of applying a lining material to an inlet tube plate of the shell-and-tube heat exchanger of claim 1 comprising:

inserting one or more sleeves into one or more heat exchanger tubes, each sleeve comprising a sleeve tube and a plate; and attaching each sleeve to the heat exchanger tube by rolling or hydraulic fastening.

* * * * *

UNITED STATES PATENT AND TRADEMARK OFFICE

CERTIFICATE OF CORRECTION

PATENT NO. : 8,210,245 B2
APPLICATION NO. : 11/994991
DATED : July 3, 2012
INVENTOR(S) : Christoph Gillessen et al.

It is certified that error appears in the above-identified patent and that said Letters Patent is hereby corrected as shown below:

In column 7 at line 41-42, In Claim 2, change “wherein the” to --wherein--.

In column 8 at line 9, In Claim 3, change “of the of the” to --of the--.

Signed and Sealed this
Nineteenth Day of March, 2013

Teresa Stanek Rea
*Acting Director of the United States Patent and Trademark Office*